US005222353A

United States Patent [19]

Stahlecker

[11] Patent Number: 5,222,353

[45] Date of Patent: Jun. 29, 1993

[54] OPEN-END SPINNING ROTOR

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany; part interest to each

[21] Appl. No.: 798,906

[22] Filed: Nov. 27, 1991

[30] Foreign Application Priority Data

Nov. 28, 1990 [DE] Fed. Rep. of Germany ..... 4037833

[51] Int. Cl.[5] ..... D01H 4/12

[52] U.S. Cl. ..... 57/406; 384/425

[58] Field of Search ..... 57/404, 406, 407, 414, 57/405, 408, 409, 410, 411, 412, 413, 415, 416, 417; 384/240, 244, 420, 425

[56] References Cited

U.S. PATENT DOCUMENTS 2,773,724 12/1956 Hadley ..... 384/425
3,805,506 4/1974 Stahlecker ..... 57/406 X
3,838,560 10/1974 Stahlecker ..... 57/406
4,186,548 2/1980 Stahlecker ..... 57/406
4,703,616 11/1987 Feuchter et al. ..... 57/406 X

FOREIGN PATENT DOCUMENTS 1901453 8/1970 Fed. Rep. of Germany .
3815182 11/1989 Fed. Rep. of Germany ..... 57/414

*Primary Examiner*—Joseph J. Hail, III
*Attorney, Agent, or Firm*—Evenson, McKeown, Edwards & Lenahan

[57] ABSTRACT

An open-end spinning rotor assembly is disclosed which includes a rotor shaft which has one end thereof supporting a spinning rotor. At an opposite axial end face of the rotor shaft, a small round plate is mounted which serves as an axial bearing surface engageable with a step bearing. The round plate is attached in a precise position on the corresponding round surface on the rotor shaft axial end. In certain preferred embodiments, the round plate and the rotor shaft end face are provided with recesses for accommodating glue or other adhesive.

24 Claims, 2 Drawing Sheets

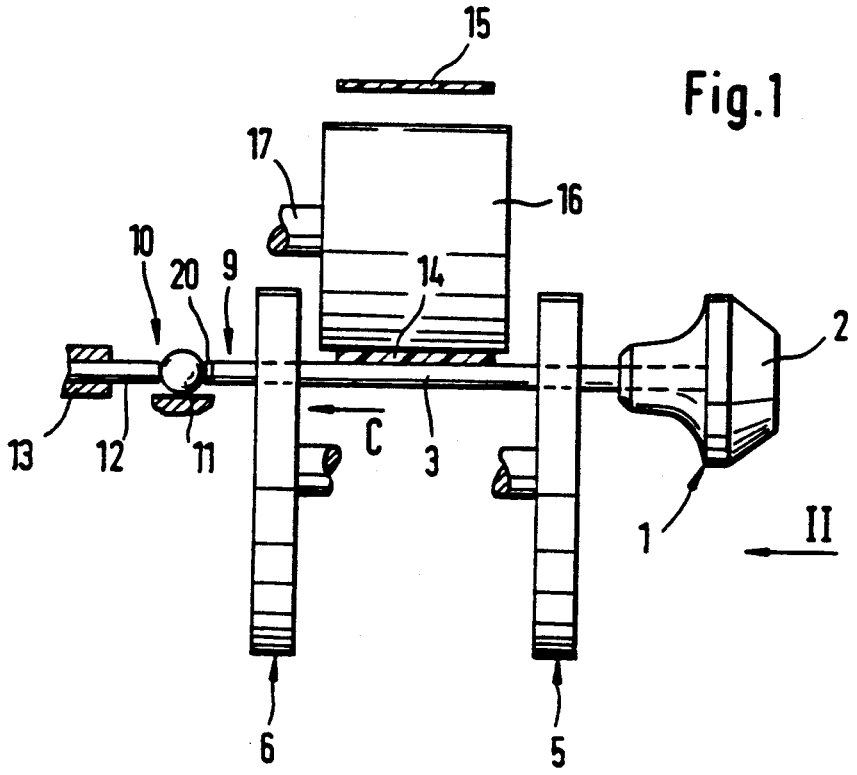
Fig.1
Fig.2
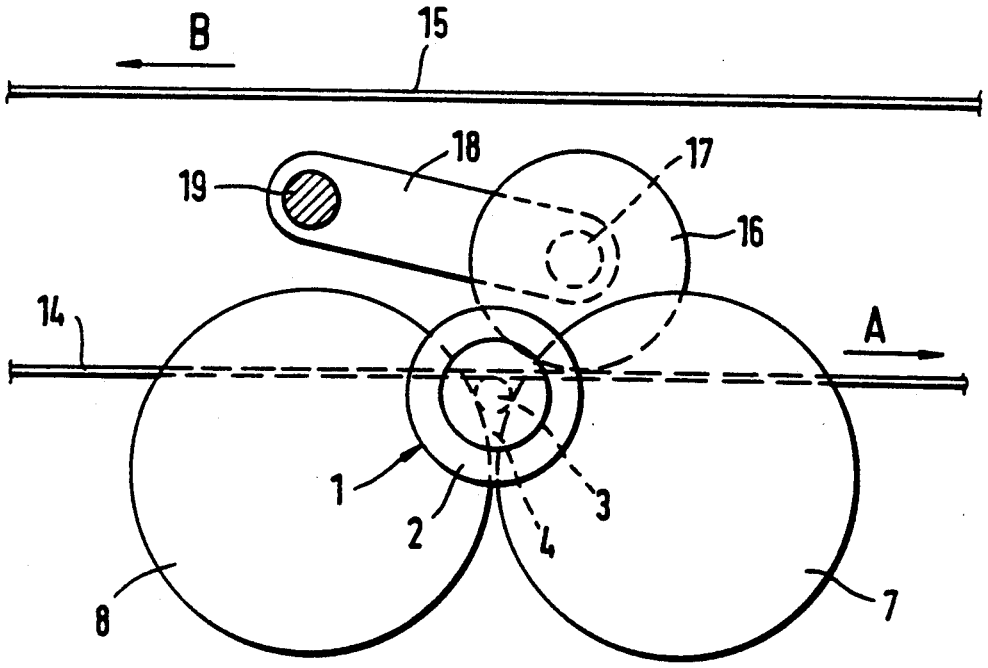

OPEN-END SPINNING ROTOR

BACKGROUND AND SUMMARY OF THE INVENTION

This invention relates to an open-end spinning rotor assembly having a rotor (rotor disk) which is provided with a rotor support shaft which serves for the radial bearing and the end of which is provided with a supporting element for the axial support against a step bearing.

In rotor spinning machines, open-end spinning rotors are wearing parts which must be replaced after a certain operating time of the machine. Previously, the rotor constituted the component part that had to be exchanged because it was worn out. However, coatings were developed by means of which the rotor achieve such a service life that today the rotor is no longer worn out first but rather the rotor support shaft. Particularly at its end which is supported on the step bearing in the axial direction, this shaft is worn to such an extent that it is shortened so that the rotor changes its axial position. Per se, it is possible to adjust the individual spinning rotors in the axial direction by means of an adjustment of the step bearing. However, in practice, this is not accepted as a solution to the wearing problem because the requirement exists that the spinning rotor assemblies (rotor and rotor shaft) of one machine must be exchangeable with respect to one another. It therefore happens that the open-end spinning rotor assemblies must be exchanged although the rotor could easily still be used.

Although it is known (German Patent Document DE-A 19 01 453, FIG. 26) to mount to the end of the shaft a hemispherical supporting device made of hard metal, of a diamond or of ceramic material which must also be exchangeable, it cannot be expected that this is a technically useful solution because this measure is definitely too expensive. In this case, it should be noted that, in the case of the extremely high rotational speeds of the rotor which today are at 100,000 $min^{-1}$ (100,000 revolution per minute) and more, high requirements must exist with respect to the concentricity of the spinning rotor. It is to be expected that an exchange of such hemispherical supporting devices will require another balancing of the spinning rotor.

It is an object of the invention to provide an open-end spinning rotor assembly of the initially mentioned type which is provided with a simple supporting device that is easy to mount, in which case, as a rule, the mounting of the supporting device does not require another balancing.

In the case of an open-end spinning rotor assembly of the initially mentioned type, this object is achieved in that the supporting element is constructed as a small round plate which, as an extension of the shaft, is mounted on its end face which extends radially with respect to the shaft axis.

Such a small round plate has only a relatively small mass so that it can cause only very minor unbalancing. In addition, it is possible to mount this small plate precisely on the end face extending radially with respect to the shaft axis so that, on the whole, the danger of an unbalancing is very low.

In a further development of the invention, it is provided that the end area of the shaft has a diameter which is reduced with respect to the area used for the radial bearing, and that the diameter of the small plate corresponds at least approximately to the diameter of the end area of the shaft. In this case, a small plate is also only required which is small with respect to its diametrical dimensions and which, because of its shape, can be centered very easily with respect to the end of the shaft.

In a further development of the invention, it is provided that the small plate is held on the end face of the shaft by means of an adhesive or gluing medium. This is a simple mounting method which can be carried out very precisely, particularly in an assembling device or fixture. In this case, under certain circumstances, an exchange of the small plate is also possible by the owner of the machines if this owner has a corresponding assembling fixture. It is also possible to develop these open-end spinning rotor assemblies as exchange components which can be restored in the manufacturing plant and can then be used again.

In a further development of the invention, it is provided that the adhesive or gluing medium forms an intermediate layer between the small plate and the end face of the shaft. The intermediate layer made of the adhesive or gluing medium, which expediently will then also be kept very thin, may serve as a damping element which protects the small plate from wear. In the case of a suitable design of the material of the small plate and/or of the intermediate layer made of an adhesive or gluing medium, it appears possible to increase the durability of the rotor shaft such that it will then correspond to the service life of the rotor so that an exchange of the small plate will then no longer be necessary. In this case, it is expedient for the small plate to be mounted on the end face of the shaft by means of a gluing agent which preferably hardens to a specifiable hardness.

In the case of another development, it is provided that the small plate is vulcanized to the end face of the shaft. Also in this case the hardness of the intermediate layer will be adjustable to the desired values.

Other objects, advantages and novel features of the present invention will become apparent from the following detailed description of the invention when considered in conjunction with the accompanying drawings.

BRIEF DESCRIPTION OF THE DRAWINGS

FIG. 1 is a schematic representation of a lateral view of a supporting disk bearing arrangement and an open-end spinning rotor assembly constructed according to the invention;

FIG. 2 is a view in the direction of the arrow II of FIG. 1;

DETAILED DESCRIPTION OF THE DRAWINGS

Figure 3:
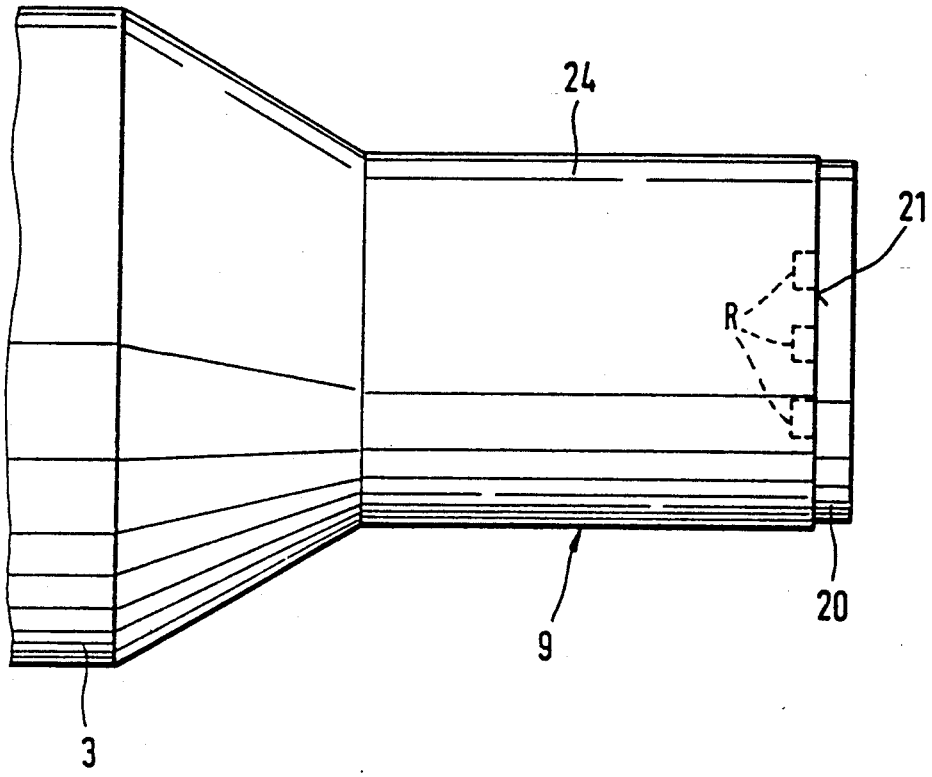
FIG. 3 is a partial lateral very enlarged view of an end of a shaft of an open-end spinning rotor assembly according to the invention.

The open-end spinning rotor assembly 1 illustrated in FIGS. 1 and 2 has a rotor 2 which is non-rotatably arranged on a rotor shaft 3. By means of its shaft 3, the open-end spinning rotor assembly is disposed in a so-called supporting-disk bearing arrangement. The shaft 3 is disposed in the radial direction in the wedge-shaped gaps 4 of two supporting disk pairs 5, 6 which each comprise two supporting disks 7, 8, whose circumference has a running surface made of a plastic fitting. The supporting disks 7, and 8 of the two supporting disk pairs situated on one side of the shaft 3 are each disposed by means of common shafts in a roller bearing which is not shown.

In the area between the supporting disk pairs 5, 6, a run 14 of the tangential belt travels against the shaft 3 and drives all open-end spinning rotors of one side of the machine. The run 14 travels in the direction of the arrow (A) so that the rotor 2 rotates clockwise. The second run 15 of the tangential belt is guided back on top in the direction of the arrow (B). The run 14 of the tangential belt is loaded in the direction toward the shaft 3 by means of a pressure roller 16 which is disposed on a swivel arm 18 for rotation about a shaft 17. The swivel arm 18 can be swivelled about a swivel shaft 19 extending transversely with respect to the run 14 and is loaded in the direction toward the shaft 3 by means of a loading spring which is not shown.

The shafts of the supporting disks 7 of one side and of the supporting disks 8 of the other side are set askew with respect to one another such that, in connection with the travelling direction (A) of the end 14 of the tangential belt and the resulting rotating direction, an axial thrust occurs in the direction of the arrow (C) onto the shaft 3 against which it is supported in the axial direction by means of a step bearing 10. The end 9 of the shaft 3 is provided with a small plate 20 serving as a supporting element by means of which the shaft 3 is supported against a step bearing ball 11 arranged in its axial extension which is supported by a pin 12 which is arranged in a holder 13 and in the axial direction can be adjusted to be in alignment with the shaft 3.

In the shown embodiment of the open-end spinning rotor assembly, which is repeated in part in FIG. 3 in an enlarged manner, the small plate 20 is a wearing part which will be exchanged as soon as its wear exceeds a permissible value. The permissible wear can be determined on the basis of the position of the rotor 2 in the spinning arrangement. As soon as this position has recognizably and measurably changed by a maximally permissible value, the open-end spinning rotor assembly is removed and is provided with a new small plate 20.

As illustrated in FIG. 3, the small plate 20 is mounted on an end area 24 of the shaft end 9 of the shaft 3 which, with respect to the area serving for the bearing at the supporting disk pairs 5, 6 is reduced to approximately half the diameter. The small plate 20 has an outside diameter which corresponds at least approximately to the outside diameter of the end area 24 which is provided with a plane end face 21 extending radially to the shaft axis. As a result, it is simple to center the small plate 20 with respect to the end area 24 and therefore with respect to the whole shaft 3 such that the danger of an unbalance is largely excluded. This centering expediently takes place in an assembling device or fixture in which the fastening of the small plate 20 to the shaft 3 also takes place. In the case of one embodiment, this fastening is carried out by means of a gluing agent, for example, by means of the gluing agent which is known under the "Loctite" trademark. This gluing agent can relatively easily be dissolved by being heated to above 300° so that the old, worn-out small plate may removed and residues of the gluing agent may also be removed from the end face 21.

In the case of a first embodiment, it is provided that the end face 21 of the shaft 3 and/or the opposite surface of the small plate, which small plate has two surfaces extending in parallel with respect to one another, have such a surface roughness that the mass of the gluing agent can be pushed between the small plate 20 and the shaft 3 into the hollow spaces in such a manner that a direct contact between the small plate 20 and the shaft 3 is ensured. In order to reliably guarantee a pushing of the gluing agent between the surface 21 and the opposite surface of the small plate, the surface 21 may also be provided with specified recesses. R shown in dashed lines in FIG. 3. In the same manner in which a gluing agent may be used, it is also contemplated to solder the small plate 20 together with the shaft 3 according to other, embodiments.

Figure 3A:
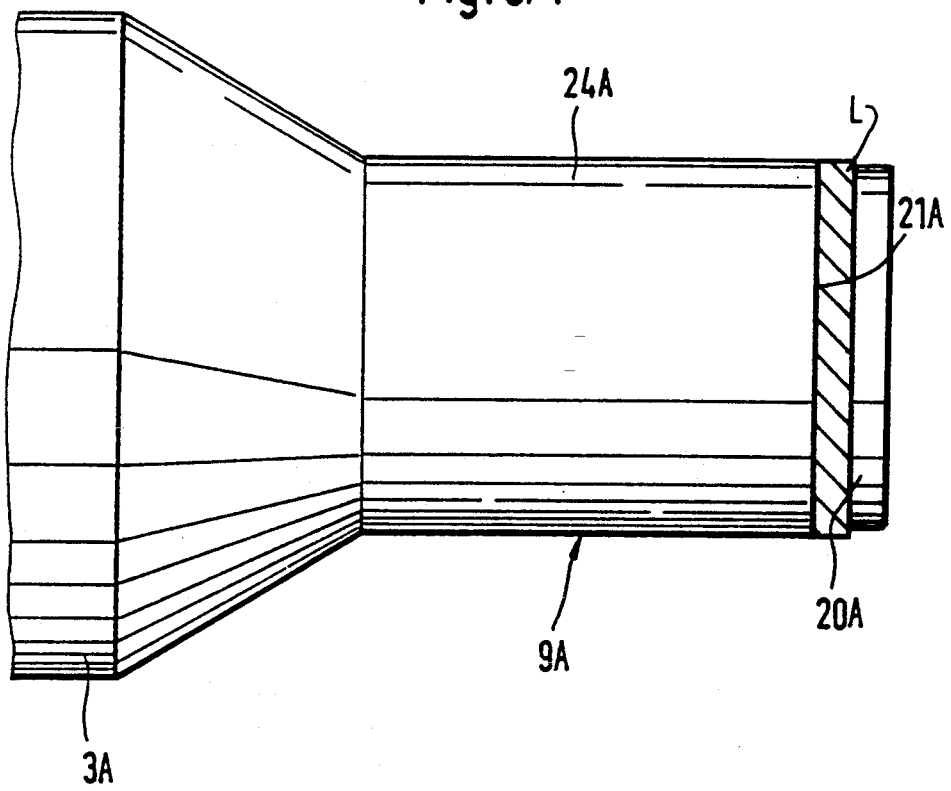
FIG. 3A is a view similar to FIG. 3, showing an embodiment with an adhesive layer.

In the case of another embodiment illustrated in FIG. 3A, it is provided that, between the small plate 20A and the end face 21A, a layer L of the adhesive or gluing agent is intentionally provided with a specified thickness or a specified hardness. In this case, a two-component gluing agent, which hardens to a predeterminable hardness, or a vulcanizable rubber or synthetic rubber may, for example, be provided. As a result, it is possible to use the layer of the adhesive or gluing agent as a damping layer which represents a wearing protection for the small plate. The small plate itself has a thickness (as an extension of the shaft axis) of approximately 0.7 to approximately 2.0 mm. The layer with the adhesive or gluing agent expediently has an axial dimension or thickness which is smaller or maximally equal to the thickness of the small plate 20. The hardness of the layer of adhesive or gluing agents, which is used as the damping element, may, for example, be in the order of the hardness which the fittings of the supporting disks 7, 8 have, that is, a hardness of approximately 60 Shore D.

The small plate 20 is preferably made of steel so that, if necessary, a regrinding on its circumferential surface will still be possible if a balancing should be required which, under certain circumstances, may be expedient when the layer consisting of the adhesive or gluing agent is used as the damping element.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An open-end spinning rotor assembly for use in a spinning unit having a bearing assembly including a step bearing, comprising:

a supporting element at an axial end of the rotor shaft which is opposite the rotor and which is engageable in use with the step bearing to axially support the rotor shaft, wherein the supporting element is constructed as a small round plate which is mounted at a planar, radially extending axial end-face of the rotor shaft, said small round plate having a diameter smaller than the diameter of the axial end face of the rotor shaft.

2. An open-end spinning rotor assembly according to claim 1, wherein an end area of the rotor shaft adjacent the axial end face has a diameter which is reduced with respect to an intermediate shaft area between the end area and the rotor.

3. An open-end spinning rotor assembly according to claim 2, wherein the small plate is held on the end face of the shaft by means of an adhesive or gluing agent.

4. An open-end spinning rotor assembly according to claim 3, wherein at least one of the end face of the shaft and an opposite surface of the small plate are provided with recesses for the receiving of the adhesive or gluing agent.

5. An open-end spinning rotor assembly according to claim 4, wherein the adhesive or gluing agent forms an intermediate layer between the small plate and the end face of the shaft.

6. An open-end spinning rotor assembly according to claim 4, wherein the small plate is mounted to the end face of the shaft by means of an adjustable hardness gluing agent.

7. An open-end spinning rotor assembly according to claim 4, wherein the small plate has an axial thickness of 0.7 to 2.0 mm.

8. An open-end spinning rotor assembly according to claim 3, wherein the adhesive or gluing agent forms an intermediate layer between the small plate and the end face of the shaft.

9. An open-end spinning rotor assembly according to claim 2, wherein the small plate is vulcanized to the end face of the shaft to form a vulcanized connection.

10. An open-end spinning rotor assembly according to claim 2, wherein the small plate is soldered to the end face of the shaft to form a soldered connection.

11. An open-end spinning rotor assembly according to claim 2, wherein the small plate is made of steel.

12. An open-end spinning rotor assembly according to claim 1, wherein the small plate is mounted to the end face of the shaft by means of a gluing agent, and wherein said gluing agent includes means for hardening to an adjustable hardness.

13. An open-end spinning rotor assembly according to claim 1, wherein the small plate is vulcanized to the end face of the shaft to form a vulcanized connection.

14. An open-end spinning rotor assembly according to claim 1, wherein the small plate is soldered to the end face of the shaft to form a soldered connection.

15. An open-end spinning rotor assembly according to claim 1, wherein the small plate has an axial thickness of 0.7 to 2.0 mm.

16. An open-end spinning rotor assembly according to claim 1, wherein the small plate is made of steel.

17. A method of making an open-end spinning rotor assembly comprising:

providing a spinning rotor assembly with a rotor attached to one axial end of a rotor shaft, and mounting a small round plate at a radially extending axial end face of the rotor shaft which is opposite the rotor, said small round plate being configured to serve as a bearing surface engageable with an axial step bearing in use of the rotor assembly, said small round plate having a diameter smaller than the diameter of the axial end face of the rotor shaft.

18. A method according to claim 17, comprising forming an end area of the rotor shaft adjacent the axial end face to have a diameter which is reduced with respect to an intermediate shaft area used for radial bearing of the rotor shaft.

19. A method according to claim 18, wherein the small plate is held on the end face of the shaft by means of an adhesive or gluing agent.

20. A method according to claim 18, wherein the small plate is soldered to the end face of the shaft.

21. An open-end spinning rotor assembly for use in a spinning unit having a bearing assembly including a step bearing, comprising:

a rotor shaft which directly supports a rotor, and a supporting element at an axial end of the rotor shaft which is opposite the rotor and which is engageable with the step bearing to axially support the rotor shaft, wherein the supporting element is constructed as a small round plate which is mounted at a planar, radially extending axial end-face of the rotor shaft;

wherein the small plate has an axial thickness of 0.7 to 2.0 mm, and wherein the small plate is adhered to the end face of the shaft by an adhesive layer which serves as a damping element to protect the small plate from wear.

22. An open-end spinning rotor assembly according to claim 21, wherein an end area of the rotor shaft adjacent the axial end face has a diameter which is reduced with respect to an intermediate shaft area between the end area and the rotor.

23. An open-end spinning rotor assembly according to claim 21, wherein the small plate is made of steel.

24. A method of making an open-end spinning rotor assembly comprising:

providing a spinning rotor assembly with a rotor attached to one axial end of a rotor shaft, and mounting a small round plate at a radially extending axial end face of the rotor shaft which is opposite the rotor, said small round plate being configured to serve as a bearing surface engageable with an axial step bearing in use of the rotor assembly, wherein the small plate has an axial thickness of 0.7 to 2.0 mm, and wherein the small plate is adhered to the end face of the shaft by an adhesive layer which serves as a damping element to protect the small plate from wear.

* * * * *